United States Patent [19]

Hsiau et al.

[11] Patent Number: 4,970,766

[45] Date of Patent: Nov. 20, 1990

[54] BUTTON ATTACHABLE TO CLOTHES WITHOUT USING THREAD

[76] Inventors: Ming F. Hsiau, No. 86-4, An Shun Pei 1 St., Pei Tun Chu, Taichung City; Wen J. Hsieh, No. 285, Chung Yang Rd., Pen Yang Li, Feng Yuan City, Taichung Hsien, both of Taiwan

[21] Appl. No.: 453,717

[22] Filed: Dec. 20, 1989

[51] Int. Cl.[5] ..... A44B 1/38

[52] U.S. Cl. ..... 24/90 R; 24/108

[58] Field of Search ..... 24/90 R, 90 A, 90 B, 24/103, 108, 112

[56] References Cited

U.S. PATENT DOCUMENTS

| | | | |
|---|---|---|---|
| 474,252 | 5/1892 | Jackson | 24/90 R |
| 485,848 | 11/1892 | Perrine | 24/108 |
| 495,270 | 4/1893 | Rozell | 24/90 R |
| 3,360,835 | 1/1968 | Foertmeyer | 24/90 R |
| 3,623,192 | 11/1971 | Papazian | 24/90 R |
| 3,689,962 | 9/1972 | Erickson | 24/90 R |
| 3,925,855 | 12/1975 | Olovson | 24/90 R |
| 4,570,306 | 2/1986 | Eyler | 24/90 B |
| 4,579,493 | 4/1986 | Schaty | 24/108 |

FOREIGN PATENT DOCUMENTS

| | | | |
|---|---|---|---|
| 1404528 | 5/1965 | France | 24/90 R |

*Primary Examiner*—Victor N. Sakran

*Attorney, Agent, or Firm*—Steinberg & Raskin

[57] ABSTRACT

A button includes a female element and a male element engageable with each other. A hole with a pawl is formed in the female element. The male element includes a base portion and a pin integrally formed together. The pin has a free tip end and one or more recesses. The pin is insertable through the hole and the pawl is engageable with one of the recesses.

2 Claims, 2 Drawing Sheets

BUTTON ATTACHABLE TO CLOTHES WITHOUT USING THREAD

BACKGROUND OF THE INVENTION

The present invention relates to a button, and more particularly to a button which can be easily attached to clothes without using thread.

Buttons have been widely used for a long time. Most of the buttons which are used nowadays are attached to clothes using thread. Another type of button in use includes a male element and a female element, in which, generally, the female element and the male element are attached to the respective parts of clothes using thread. This is very inconvenient, especially for a clothes factory where a large amount of clothes are produced everyday. It takes a considerable amount of time to attach the buttons onto the clothes so that productivity thereof is low. In addition, when a button becomes loose, the user has to find a needle and thread to sew the button onto the clothes again.

The present invention has arisen from a need to mitigate and/or obviate the afore-described disadvantages of the conventional button.

SUMMARY OF THE INVENTION

The primary objective of the present invention is to provide a button which can be easily attached to clothes without using thread.

In accordance with one aspect of the present invention, there is provided a button including a female element and a male element engageable with each other. A hole with a pawl is formed through the female element. The male element includes a base portion and a pin integrally formed together. The pin has a free tip end and one or more recesses on its surface between the tip end and its base. The pin is insertable through clothes and the hole so that the pawl is engageable with one of the recesses.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
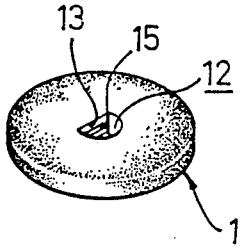
FIG. 1 is an enlarged perspective view of a female element of a button in accordance with the present invention.
Figure 2:
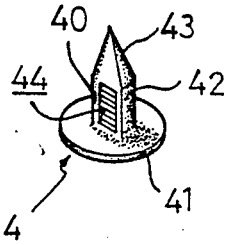
FIG. 2 is an enlarged perspective view of a male element of the button in accordance with the present invention.
Figure 3:
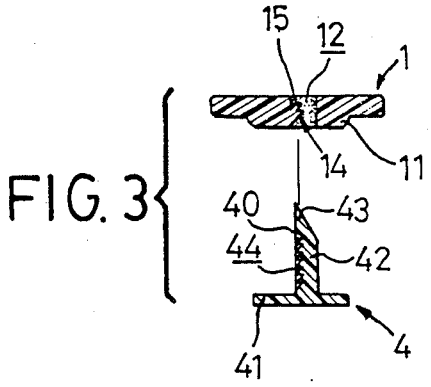
FIG. 3 is a cross-sectional view of the male and the female elements of the button when separate.

Referring to the drawings and initially to FIGS. 1, 2 and 3, a button in accordance with the present invention comprises generally a female element 1 and a male element 4 engageable with each other.

The female element 1 is substantially a disc-shaped body with a reduced diameter flange portion 11 formed on a lower surface thereof. The flange portion 11 may have a shape, such as an annular disc, or a shape such as an ellipse, a rectangle, a triangle or the like, which is different from annular shape. It is preferable that the lower surface of the flange portion 11 is convex or substantially spherically shaped. A hole 12 with a flat surface 13 is formed through the center portion of the female element 1. A pawl 14 is integrally formed on the flat surface 13 of the female element 1 and is substantially located within the hole 12. The pawl 14 extends inward and upward from a lower end of the flat surface 13 so that a free end of the pawl 14 is flexible. As shown in the drawings, there are two teeth formed at the free end of the pawl 14. Each tooth has a level upper surface and an inclined lower surface. It is to be noted that the cross-section of the hole 12 can be a rectangular hole, a triangular hole or the like which has at least one flat surface. It is preferable that a pawl 14 is formed on each flat surface.

The male element 4 includes a base portion 41 which is substantially disc-shaped, and a pin 42 vertically and integrally formed on a surface of the base portion 41. The pin 42 has a flat side 40 and a substantially conical tip portion 43. The size and the configuration of the pin 42 is such that the pin 42 is insertable through the hole 12 of the female element 1. A plurality of tooth-shaped recesses 44 are formed in series on the flat side 40 of the male element 4. Each recess 44 has a level upper surface and an inclined lower surface which correspond to the respective surfaces of the pawl 14. It is preferable that the base portion 41 has a size the same as that of the annular flange 11 of the female element 1.

It is to be noted that the sizes of the female element 1 and the male element 4 as shown in the drawings are enlarged. In fact, the disc-shaped body of the female element 1 has a size corresponding to that of a conventional button. The diameter or the largest width of the pin 42 is about 1.5 mm.

Figure 4:
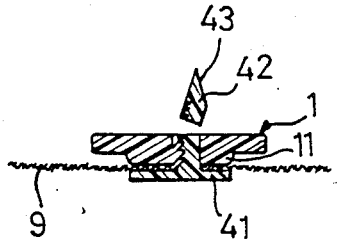
FIG. 4 is a cross-sectional view of the male and the female elements of the button as attached to clothes.

Referring next to FIG. 4, when in use, the female element 1 is provided on an outer surface of an article of clothing 9 with the annular flange 11 contacting the clothes 9. The tip portion 43 of the pin 42 of the male element 4 is forced through the material of the clothes 9 and the hole 12 of the female element 1 until the material of the clothes 9 is snugly clamped between the female element 1 and the male element 4. The tip portion 43 facilitates the insertion of the pin 42 through the material of the clothes 9, and the inclined lower surface of the pawl 14 facilitates the insertion of the pin 42 into the hole 12. The annular flange 11 provides a small distance between the material of the clothes 9 and the disc-shaped body of the female element 1 so that the button can be easily inserted into a button hole (not shown) in a respective portion of the clothes 9. The upper portion of the pin 42 which protrudes above the upper surface of the female element 1 is cut off when the female element 1 and the male element 4 are engaged in a suitable position. The female element 1 and the male element 4 are preferably made of plastic materials.

Accordingly, the present invention has the following advantages:

(a) The button can be easily attached to clothes without using thread so that productivity is greatly improved.

(b) It is not easy for the button to be separated from the clothes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A button comprising a female element and a male element engageable with each other; a hole being formed through said female element, said hole having at least one flat surface; at least one pawl being formed on said flat surface and extending inward and upward in said hole; said male element including a base portion and a pin integrally formed thereon, said pin having a cross section corresponding to said hole and having at least one flat side corresponding to said flat surface of said hole, said pin having a free tip end and at least one recess being formed on said flat side of said pin, said pin being insertable through said hole and said pawl being engageable with said recess.

2. A button according to claim 1, wherein said pawl has at least one tooth formed at a free end thereof, each tooth has a first level upper surface and a first inclined lower surface; and each said at least one recess has a second level upper surface and a second inclined lower surface corresponding to that of said tooth so that said pin of said male element is insertable through said hole from a lower end thereof and each said tooth of said pawl is respectively engaged with said recess of said pin.

* * * * *